United States Patent [19]

Katayama et al.

[11] Patent Number: 4,697,987

[45] Date of Patent: Oct. 6, 1987

[54] ROTARY MACHINE HAVING AN IMPELLER WITH A SLEEVE FIXEDLY MOUNTED TO A SHAFT

[75] Inventors: Kazuzo Katayama; Taku Ichiryu; Tsuneyoshi Mitsuhashi; Yasushi Mouri; Masanori Kobayashi, all of Takasago, Japan

[73] Assignee: Mitsubishi Jukogyo Kabushiki Kaisha, Tokyo, Japan

[21] Appl. No.: 832,600

[22] Filed: Feb. 25, 1986

[30] Foreign Application Priority Data

Jun. 19, 1985 [JP] Japan ..... 60-91554[U]

[51] Int. Cl.[4] ..... F01D 5/04

[52] U.S. Cl. ..... 416/204 A; 416/244 A; 416/198 A

[58] Field of Search ..... 416/244 A, 244 R, 204 A, 416/198 A, 198 R, 200 A, 135; 415/198.1, 199.1, 199.2

[56] References Cited

U.S. PATENT DOCUMENTS

| | | | |
|---|---|---|---|
| 2,799,445 | 7/1957 | Hull | 416/244 A |
| 3,184,153 | 5/1965 | Zech et al. | 416/198 A |
| 3,612,719 | 10/1971 | Nomura | 416/135 X |
| 4,053,261 | 10/1977 | Pennig | 416/244 A |

FOREIGN PATENT DOCUMENTS

| | | | |
|---|---|---|---|
| 58-190598 | 11/1983 | Japan | 416/244 A |
| 219655 | 10/1924 | United Kingdom | 416/244 A |
| 523994 | 11/1976 | U.S.S.R. | 416/244 A |

*Primary Examiner*—Robert E. Garrett
*Assistant Examiner*—Joseph M. Pitko
*Attorney, Agent, or Firm*—Birch, Stewart, Kolasch, & Birch

[57] ABSTRACT

An improved rotary machine such as centrifugal type compressor adapted to rotate under high load of the type including a plurality of impellers fixedly mounted (shrinkage-fit) on a main shaft. To effectively inhibit the rotor from vibrating due to loosened fitting of the impellers onto the main shaft the improvement consists of each of the impellers being provided with a sleeve portion which is made integral with the impeller. The sleeve portion is located at a position removed from the main part of the impeller along the axial direction of the main shaft with the position being determined in accordance with the theory of strength of materials in such a manner that displacement of the impeller in the radial direction due to centrifugal force resulting from rotation of the rotary machine has no effect on determination of the position of the sleeve portion, wherein the sleeve portion is shrink fit onto the main shaft of the impellers.

5 Claims, 2 Drawing Figures

ROTARY MACHINE HAVING AN IMPELLER WITH A SLEEVE FIXEDLY MOUNTED TO A SHAFT

BACKGROUND OF THE INVENTION

1. Field of the Invention

The present invention relates to a rotary machine of the type including a plurality of impellers which are fixedly mounted on a main shaft and more particularly to an improvement of or relating to a rotor or impeller of the rotary machine such as a steam turbine, gas turbine or the like which is shrink fit onto the main shaft.

2. Description of the Prior Art

During rotation of impellers in a centrifugal type compressor under high load at a high rotational speed, thrust force generated by a high centrifugal force as well as a pressure differential appearing across each of the impellers is exerted on the impellers. There is a necessity for correctly maintaining the center of rotation during operation of the rotary machine without any occurrence of slippage of the impellers on the main shaft under the effect of thrust force irrespective of how much the inner diameter of the impellers expand in the radial direction under the effect of centrifugal force. To prevent an occurrence of slippage of the impellers on the main shaft there has been exclusively employed a method of fixedly mounting impellers on the main shaft by shrink fitting instead of the conventional methods using spline, key, press fitting or the like means.

To facilitate understanding of the invention one of the conventional methods for fixedly mounting impellers on the main shaft is shown in FIG. 2. The inner peripheral portion C of each of the impellers 1 is shrink fit onto the main shaft 2 and the portions D of a sleeve 3 separated from the impeller 1 are also shrink fit onto the latter.

As is well known, the latest rotary machine tends to operate under conditions of higher rotational speed and higher load and therefore there is greater concern in failing to operate the rotary machine in the stable state in which impellers are rigidly mounted on the main shaft in accordance with the conventional shrink fitting method. As the impellers 1 are rotated at a higher rotational speed, a higher centrifugal force is generated, resulting in increased expansion of the inner peripheral portion C in the radial direction. To ensure that torque is properly transmitted from the main shaft 2 to the impeller 1 with the main shaft 2 being rotated against forces exerted on the main shaft 2 due to pressure exerted on the impellers, it is required that a sufficiently high frictional force exist between the outer peripheral surface of the main shaft 2 and the inner peripheral surface of each of the impellers 1. To meet the requirement there is a necessity to provide a sufficient dimension of shrink fit. As the dimension of shrink fit increases, stress in the tangential direction in the inner peripheral wall of the impeller during shrink fitting increases, resulting in an increased differential of stress between operation of the compressor and during stoppage of operation of the same. This causes the inner peripheral portion of each of the impellers to expand and contract every time the compressor starts its operation and stops and distribution of surface pressure active on the impellers in the axial direction varies. This leads to displacement of the impellers 1 relative to the main shaft 2 causing an occurrence of vibration of the rotor.

For instance, when it is assumed that the outer diameter of the impeller 1 is 400 mm, the inner diameter of the same is 130 mm and the number of revolutions is 15,000 r.p.m., the inner diameter expands by a dimension of about 2/1000×(inner diameter) when they are rotated. If a distance of shrink fit is predetermined to be 2.5/1000×(inner diameter), only an effective distance of shrink fit of 0.5/1000×(inner diameter) exists during rotation of the impellers. The above-noted effective distance of shrink fit is not sufficient for assuring reliable transmission of torque from the main shaft 2 to the impellers 1 and producing a frictional force which is sufficient to satisfactorily stands differential pressure across each of the impellers. Further, to achieve shrink fitting of a dimension of 2.5/1000×(inner diameter) it is required that each of the impellers is heated up to an elevated temperature in the range of 300° to 350° C. in a furnace. Any requirement for an increased dimension of shrink fit is limited by heating temperature.

SUMMARY OF THE INVENTION

Thus, the present invention has been made with the foregoing problems in mind and its object resides in providing a rotary machine which ensures that vibration of the rotor due to loosened fitting of the impellers on the main shaft is prevented effectively and high reliability of operation of the machine is obtained.

Another object of the present invention is to provide a rotary machine which can use a main shaft having the same length as that of the conventional rotary machines owing to advantageous features which will be described later.

To accomplish the above objects there is proposed a rotary machine of the type including a plurality of impellers which are immovably mounted on a main shaft, characterized in that each of the impellers is provided with a sleeve portion which is made integral with the impeller, the sleeve portion being located at a position removed from the main part of the impeller along the axial direction of the main shaft, the aforesaid position being determined in accordance with the theory of strength of materials in such a manner that displacement of the impeller in the radial direction due to centrifugal force generated by rotation of the rotary machine has no effect on the position of the sleeve portion, wherein the sleeve portion of the impellers is shrink fit onto the main shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The the present invention will be described in a greater detail hereunder with reference to FIG. 1 which illustrates a preferred embodiment thereof.

Figure 1:
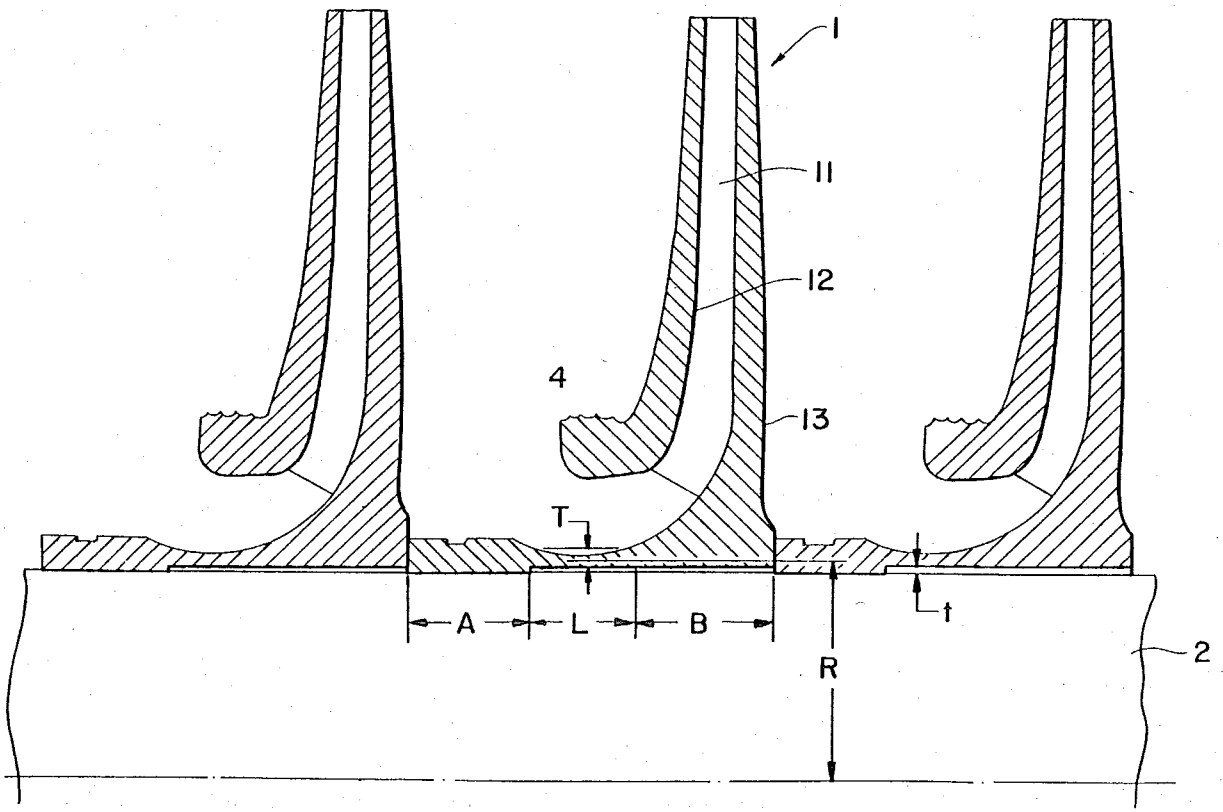
FIG. 1 is a fragmented sectional view of a rotor for a centrifugal type compressor in accordance with a preferred embodiment of the present invention.
Figure 2:
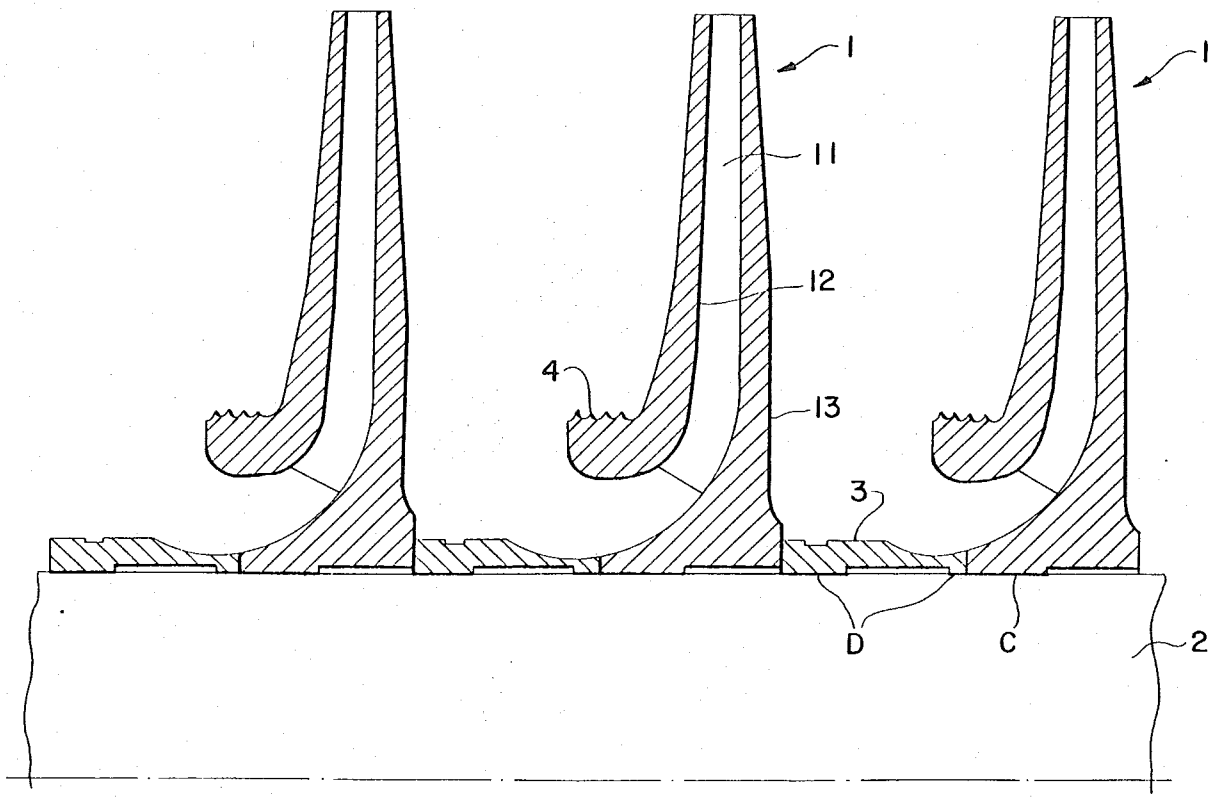
FIG. 2 PRIOR ART
FIG. 2 is a fragmented sectional view of a conventional rotor for a centrifugal type compressor.

FIG. 1 illustrates a rotor for a centrifugal type compressor by way of fragmented sectional view. A plurality of impellers 1 are shrink fit onto a main shaft 2 with their sleeve portions A. For the purpose of simplification description will be made below only as to the impeller located at the middle among three impellers. As will be apparent from the drawing, the impeller 1 is constituted by the combination of a plurality of blades 11, a side plate 12 and a main plate 13. A large portion of the centrifugal force generated by rotation of the impeller 1 is exerted on the inner peripheral portion B of the main plate 13. As taught by the theory of strength of materials, a length L at which centrifugal force generated by the impeller 1 has no effect on the sleeve portion A can be represented by the following inequality.

$$L \geqq 1.8\sqrt{RT}$$

where

R: average radius of the sleeve portion of impeller the

T: average thickness of the L portion

The present invention provides in that the sleeve portion A is located removed from the inner peripheral portion B of the main plate 13 by the distance L which has been represented by the above inequality, wherein centrifugal force generated by the rotation of the impeller 1 is exerted directly on the inner peripheral portion B of the main plate 13. The embodiment as illustrated in FIG. 1 is concerned with a single side suction type multistage compressor and only three impellers are shown in the drawing for illustrative purposes. It should of course be understood that the present invention should not be limited only to this but it may be applied to a double sided suction type multistage compressor.

In the illustrated embodiment the sleeve portion A is disposed on the left side relative to the impeller 1 as seen in the drawing. Alternatively, the sleeve portion A may be disposed on the right side, that is, on the rear side relative to the impeller 1. As will be seen from the drawing, a fine clearance t is provided between the inner peripheral portion B of the impeller 1 and the main shaft 2 as well as along the length L of the same and the main shaft 2. Incidentally, the drawing reference numeral 4 designates a plurality of labyrinth fins.

Next, function of the invention will be described below.

As will be readily understood from the above description, the sleeve portion A is entirely free from the influence of centrifugal force generated by rotation of the impeller, because it is located removed from the portion B by a distance of length L which is determined by the theory of strength of materials, wherein the portion B is an operative area under the effect of centrifugal force. Since the shrink fit sleeve portion A is considered as a thin-walled cylinder, it is obvious that stress and expansion of the sleeve portion A in the radial direction due to centrifugal force induced by rotation of the impeller can be reduced. Description will be made below as to an example.

It is assumed that the sleeve portion A has an outer diameter of 142 mm and an inner diameter of 130 mm and it is rotated at a rotational speed of 15,000 rpm. At this rotational speed the amount of expansion of the inner diameter of the sleeve portion A in the radial direction is represented by about 0.5/1000×(inner diameter). If a distance of shrink fit is predetermined to be 2.5/1000×(inner diameter), an effective distance of shrink fit of 2/1000×(inner diameter) exists during rotation of the impeller. Thus, there is substantially no possibility of disengagement of the impeller from the main shaft and thereby stable operation of the compressor is ensured.

Since the rotary machine of the present invention is constructed in the above-described manner, vibration of the rotor due to loosened fitting of the impellers on the main shaft of a rotary machine under the influence of high load does not occur, resulting in improved reliability of the rotary machine being ensured. When considering the overall structure of the rotary machine, modification of a conventional machine is limited only to an extent that the divided structure of the sleeve is modified to an integral one and therefore there is no requirement for any change in respect to the length of the main shaft.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A rotary machine comprising:

a rotatable shaft, and an impeller fixedly mounted to said rotatable shaft wherein said impeller comprises:

an impeller body;

a substantially thin-walled sleeve portion positioned at a predetermined distance with respect to said impeller body along a longitudinal axis of said rotatable shaft, and wherein said sleeve portion is shrink fitted to said rotatable shaft; and a substantially thin-walled cylindrical web portion connecting said thin-walled sleeve portion to said impeller body, whereby essentially only bending forces are exerted on said substantially thin-walled cylindrical web portion by centrifugal forces exerted on said impeller body during operation of said rotary machine.

2. The rotary machine according to claim 1, wherein a substantially thin annual clearance is provided between said rotatable shaft and a combination of said impeller body and said substantially thin-walled sleeve portion.

3. The rotary machine according to claim 1, wherein an outer surface of a cross section, along said longitudinal axis of said rotatable shaft, of a combination of a portion of an outer surface of said impeller body, an outer surface of said thin-walled cylindrical web portion and a portion of an outer surface of said thin-walled sleeve portion form an essentially continuous curve.

4. The rotary machine according to claim 3, wherein said continuous curve is concave shaped.

5. The rotary machine according to claim 1, wherein the dimensions of said rotary machine are defined by the relationship:

$$L \geqq 1.8\sqrt{RT}$$

where

L=length of said thin-walled cylindrical web portion,

R=an average radius of said thin-walled sleeve portion, and

T=an average thickness of said thin-walled cylindrical web portion.

* * * * *